US005423900A

United States Patent [19]

Klintworth et al.

[11] Patent Number: 5,423,900

[45] Date of Patent: Jun. 13, 1995

[54] METHOD FOR BLOWING OXIDIZING GASES INTO MOLTEN METAL

[75] Inventors: Klaus Klintworth, Buxtehude; Rainer Zechner, Bad Oldesloe; Rudolf Flesch, Hamburg; Manfred Redetzky, Norderstedt, all of Germany; Harald Berger, Linz; Johannes Steins, Gallneukirchen, both of Austria

[73] Assignee: KCT Technologie GmbH, Germany

[21] Appl. No.: 137,735

[22] Filed: Oct. 19, 1993

[30] Foreign Application Priority Data

Nov. 19, 1992 [DE] Germany ..... 42 38 970.4

[51] Int. Cl.[6] ..... C21C 5/34

[52] U.S. Cl. ..... 75/414; 75/556; 75/585; 75/649; 266/47

[58] Field of Search ..... 75/414, 501, 556, 649; 266/47

[56] References Cited

FOREIGN PATENT DOCUMENTS 1149914 6/1989 Japan ..... 75/556

*Primary Examiner*—Melvyn J. Andrews

*Attorney, Agent, or Firm*—Nikaido, Marmelstein, Murray & Oram

[57] ABSTRACT

The invention relates to a method for blowing oxidizing gases into molten metal located in a reaction vessel having tuyères below the metal bath surface, whereby the oxidizing gases are blown into the molten metal from these tuyères and fed to the tuyères at an inlet pressure between 85 bars and 170 bars.

8 Claims, No Drawings

METHOD FOR BLOWING OXIDIZING GASES INTO MOLTEN METAL

The present invention relates to a method for blowing oxidizing gases into molten metal located in a reaction vessel having tuyères below the metal bath surface.

Progressive metallurgical methods for metal production mainly use oxygen as a refining agent today, particularly if this refining gas is fed to the smelt below the metal bath surface. This procedure has become more and more common in nonferrous metallurgy. For example, oxygen tuyères below the bath surface are used in the QSL reactor for lead production that has recently become known. Similar process variants are also part of industrial practice in copper production.

However oxygen refining has acquired outstanding importance in steel production. Along with the various LD processes for steelmaking in a converter, oxygen tuyères below the iron bath surface are now also employed in the other important steelmaking aggregate, the electric-arc furnace, to improve the economy of this process. In the bottom-blowing converter the large-scale use of pure oxygen began in 1968 with the method known as OBM or Q-BOP. German patent no. 15 83 968 is the first protective right to describe the OBM method.

Further developments in this field followed, the combination-blowing KMS converter being the current, very versatile and optimal solution for steel production. In this method the scrap smelting capacity can be controlled within wide limits by the addition of carbonaceous fuels, and the thermic efficiency of these fuels is considerably increased by the afterburning of the reaction gases and retransfer of the resulting heat. This increase of the energy turnovers in converters is protected by German patent no. 28 38 983.

A step toward improved operation of the process in the bottom- or combination-blowing converter has been taken for the top-blowing or LD method by purging the bottom with inert gas. The relatively small amounts of purging gas used (mainly nitrogen and argon) are replaced by oxygen in the LET process. In this process about 5 $Nm^3$ oxygen per ton of steel is blown into the smelt through two to four bottom tuyères below the bath surface, and the essential refining oxygen fraction is fed to the iron bath by the water-cooled oxygen top-blowing lance, as customary in an LD converter.

In steelmaking in an electric-arc furnace the KES method, as described e.g. in German patent no. 36 29 055, has recently gained acceptance in several mills. In this method for increasing the energy supply in electric-arc furnaces oxygen or oxygenous gases are blown into the upper area of the furnace for afterburning the reaction gases, and oxidizing gases (mainly oxygen) are fed to the smelt through the tuyères disposed in the bottom. Simultaneously solids such as slag forming agents and carbonaceous fuels can be passed into the smelt via hollow electrodes. This method increases the economy in particular by saving electric energy. This protective right also proposes operating the tuyères below the bath surface at increased pressure up to 60 bars from case to case.

In the methods stated hitherto the oxygen is supplied below the bath surface through so-called OBM tuyères, i.e. oxygen tuyères jacketed with hydrocarbons for their protection. These tuyères normally comprise two concentric pipes with oxygen flowing through the central pipe, and hydrocarbons, for example natural gas, methane, propane, butane or light fuel oil, flowing through the annular gap. When this tuyère is used minimal rates of wear of the bottom lining and tuyères of 1.5 mm per batch, corresponding to approximately 5 mm per hour of blowing time, can be reached under favorable operating conditions as stated for example in German patent no. 34 03 490, "A method for installing a converter bottom".

Alongside the successful large-scale use of OBM tuyères, i.e. tuyères through which oxygen jacketed by a gaseous or liquid hydrocarbon passes into the smelt below the metal bath surface, there was previously no lack of attempts to pass oxygen into molten metal without a tuyère protecting medium. For example U.S. Pat. No. 2,333,654, filed in 1940, describes a method and apparatus for steelmaking wherein oxygen is blown into the molten metal through a positively cooled tuyère in a Bessemer converter or similar refining vessel. The tuyère is made of a material with high thermal conductivity and has a water cooling system with water flowing at high speed onto the underside of the tuyères so that a layer of solidified metal forms on the tuyère surface for tuyère protection. This method has never entered into steelmaking practice, probably because the risk of leaks and bursts in the tuyère water cooling system and resulting water vapor explosions was considered too great.

U.S. Pat. No. 2,855,293, filed in 1955, relates to a further method and apparatus for treating molten metal with oxygen. The method is characterized in that oxygen with a pressure over 28 bars (400 pounds per square inch) is used to obtain a limited cooling effect at the tip of the tuyère so that the tuyère material does not melt. The application of the method and apparatus is bound to a number of requirements. The most important conditions are an oxygen pressure between 28 bars and 70 bars (400 to 1000 pounds per square inch), a jet and tuyère area between 0.003 to 0.03 square inches, corresponding to an inside pipe diameter of 1.5 mm to 5 mm, and a pipe wall thickness of at least 4.8 mm. Under these conditions and with a proper refractory material for the tuyère surroundings one can reach a minimal rate of wear of 0.27 inches/min, corresponding to 6.86 mm/min or 411 mm/h. These rates of wear based on the wall thickness of a modern bottom-blowing converter lead to operating times of less than 10 batches, while customary comparable bottom durabilities today are over 1000 batches.

The method described in this U.S. patent for passing oxygen into the smelt below the metal bath surface at a pressure between 28 bars and 70 bars has not been applied in steelmaking or metal extraction. Instead the same inventors recommended blowing oxygen into a molten metal bath only together with one or more gaseous hydrocarbons in French patent no. 14 50 718, filed in 1965.

As described above, this method of jacketing the oxygen with hydrocarbons has become accepted in metallurgical processes for metal production and leads to satisfactory results in particular with respect to the rates of wear of the tuyères used and the resulting high economy. But there are also disadvantages. Mainly in steelmaking the relatively high hydrogen contents from the tuyère protecting medium impair the finished molten steel. Also, complicated controlling installations are necessary for reasons of safety, for example to keep the pressure of the hydrocarbons lower than the oxygen pressure so that the hydrocarbons do not overflow into the oxygen pipes and cause undesirable deflagrations and fires in the feed system. Finally a considerable proportion of the hydrocarbons for tuyère protection is lost as vagrant medium in the converter bottom and leads to undesirable flame formation outside the converter, e.g. in the area of the piping on the converter bottom.

The invention is accordingly based on the problem of reliably passing oxygen into molten metal below the bath surface without a jacket of hydrocarbons or other additional tuyère protecting media and obtaining comparable rates of wear of the pass-in system and the surrounding refractory lining as are known from OBM tuyères.

The object of the invention is a method for blowing oxidizing gases into molten metal located in a reaction vessel having tuyères below the metal bath surface, characterized in that the oxidizing gases, in particular oxygen, are blown into the molten metal from these tuyères and fed to the tuyères at an inlet pressure between 85 bars and 170 bars, preferably between 90 bars and 120 bars.

These measures cause the tuyères to burn back together with the surrounding refractory material uniformly at a rate of wear of less than 30 mm/h of blowing time. No undesirable substances need be fed to the molten metal. Reliable process control and an improved, high overall economy of the method are ensured.

The inventive method can be used in steelmaking in a converter, an electric-arc furnace and other suitable vessels (ladles, vacuum systems) for carrying out a refining process, in coal gasification in an iron bath, in the smelting reduction of metal ores and in the production of nonferrous metals.

The invention is based on the finding that the resistance of tuyères to premature burning back increases over-proportionately only as of a pressure stage of at least 85 bars for the passed-in oxidizing gas, in particular oxygen. This finding is surprising because in known methods for blowing oxygen into molten metal relatively high burn-off rates for the tuyères have hitherto been detected in the pressure range between 28 bars and 70 bars and in exceptional cases up to 80 bars, which somewhat decreased at increasing pressure but still have values of about 40 cm/h of blowing time in favorable cases. The constant slight decrease in the tuyère burn-off rate at increasing oxygen pressure is only explainable in the prior art by the Joules-Thomson effect, which causes cooling on the tip of the tuyère when the highly compressed gas emerges and expands.

It is all the more surprising that an overproportionate, clear reduction of tuyère burn-off occurs according to the invention at a pressure of at least 85 bars. This tuyère burn-off found is less than 3 cm/h of blowing time and is thus in the same order of magnitude as with OBM tuyères in which the oxygen is jacketed by hydrocarbons.

According to the invention the oxygen is conducted, before entering the tuyères, through supply pipes having a clearly greater free cross section than the tuyère in order to minimize the pressure losses in these feed pipes. It has been shown that the full oxygen pressure of at least 85 bars, preferably 90 bars, must be present at the inlet of the tuyère, i.e. its back or cold side, to ensure maximum flow rates within the tuyère itself. It is also within the scope of the invention to give the tuyères a conic form, i.e. a cross section tapering toward the tuyère mouth. Instead of a conic design the tuyères can also have several steps worked into the inside diameter. These measures for tapering the inside diameter of the tuyère toward the tip are always expedient when the lower limit of the stated pressure range of at least 85 bars is present, i.e. if no higher oxygen pressure is available. The preferred design of the tuyère for the inventive method is a tubular tuyère body with a uniform inside diameter which is supplied with oxygen in the pressure range of 90 bars to 120 bars.

Other tuyère areas departing from the circular shape can of course also be used, for example oval, slotlike and any desired polygonal shapes.

According to the invention the oxygen is fed to the tuyères at temperatures of −5° C. to 50° C., preferably about 10° C. to 30° C. At this temperature the oxygen is thus present at the inlets of the tuyères. The density of the oxygen in the supply pipes and accordingly at the inlets of the tuyères is between 120 g/dm$^3$ and 240 g/dm$^3$, preferably between 130 g/dm$^3$ and 170 g/dm$^3$. The advantageous low rates of wear of the tuyères can be reached by the inventive method with the stated values for the density of the oxygen.

The unforeseeable great reduction in the tuyère burn-off rate when passing oxygen into molten metal as soon as the pressure range of about 85 bars is exceeded according to the invention cannot be explained by the Joules-Thomson effect, i.e. the gas expansion at the tip of the tuyère. Instead, more exact physicochemical tests have shown that the gas expansion hardly leads to cooling of the surroundings in this pressure range. Similar conditions also result for the calculation of the cooling effect through the hydrocarbon jacket of the oxygen in OBM tuyères. The cracking energy of the hydrocarbons is compensated almost completely by combustion of the carbon to CO, resulting in an approximately heat-neutral behavior of the hydrocarbon gases when passing into an iron smelt. While the effect of the hydrocarbon jacket is today regarded more as a retardation of the reaction by the hydrocarbons or their cracking products when oxygen is passed into an iron smelt, there is only a very vague interpretation of the surprising finding of an above-average reduction of wear when oxygen is blown in at pressures over 85 bars. The reaction zone of the oxygen with the molten metal is probably shifted forward to the tuyère mouth as of this pressure level by the high flow rate of the oxygen in the tuyère feed pipe and the expansion at the tip of the tuyère, alongside the expected cooling effects. The distance between the tuyère mouth and the area in front of it with maximum reaction density between oxygen and e.g. the iron smelt and thus the iron oxide formation —FeO— is large enough to clearly reduce the reactive effect of this high-temperature zone on the tip of the tuyère. It is conceivable that as the oxygen blowing pressure increases a reaction distance slowly forms here as described between the tip of the tuyère and the main reaction zone. But this reaction distance only has measurable effects on the burn-off rate of the oxygen tuyère as of a certain pressure level. Although these explanations may appear speculative at first they are compatible with previous findings in this field. By comparison, the ignition zone of a Bunsen burner is e.g. also shifted forward as the gas pressure increases.

The tuyères used may normally be usual commercial pipes. The dimensions of the tuyères vary in accordance with their application. No narrow limits are given by the inventive method here. For example the length of the tuyère is about 1 m and its inside diameter 6 mm when installed in the bottom of a steelmaking converter. The tuyère is made from a usual commercial copper pipe with a wall thickness of 3 mm. Inside tuyère diameters of about 1 mm to about 20 mm have proven suitable. Oxygen tuyères with an inside diameter of 2 to 6 mm are preferably used.

When selecting the material one should give preference to materials which do not ignite in the presence of oxygen and then possibly burn back in uncontrolled fashion, as for example unalloyed steel pipes behave. Copper, copper alloys and stainless or high-alloy steel pipes are accordingly recommendable. In special cases ceramic pipes, in particular multilayer ceramic pipes, have proven useful as oxygen tuyères. These multilayer ceramic pipes involve at least two and up to five concentrically fitting pipes of the same or different materials, for example corundum, mullite, spinel, magnesite, which can also be glued together. These adhesive layers can improve the material properties, such as resistance to change of temperature, thermal conductivity and breaking strength. Combinations of ceramic and metal pipes can likewise be used as oxygen tuyères.

The tuyères can be installed in the refractory lining of the refining vessel below the metal bath surface by inserting the tuyère and fixing it in the center of a prefabricated tuyère channel having an inside diameter 1 mm to 20 mm greater than the outside diameter of the tuyère. The remaining annular gap is filled with a ceramic casting compound, or one preferably uses a tuyère shake-in compound which is compressed better than a normal casting compound through the vibration of the tuyère when poured into the free annular gap. After installation of the tuyères their mouths are flush with the surrounding refractory material, or the tuyère pipes protrude slightly. No beehive-like bulges of refractory material containing the oxygen pass-in pipe are necessary as described in the prior art.

When the inventive method was applied in a combination-blowing oxygen converter for steelmaking there were considerable advantages for the production sequence in comparison to the use of OBM tuyères. In steel finery by the known method the bottom of the converter with a capacity of 65 t contains eight tuyères with an inside diameter for the central oxygen pass-in pipe of 24 mm. Surrounding the oxygen pass-in pipe is an annular gap with a width of 1 mm through which about 10% natural gas based on the oxygen throughput flows for tuyère protection. About 60% of the total amount of oxygen is passed into the iron smelt below the bath surface through these bottom tuyères. The flow rate is about 12,000 $Nm^3/h$ at a mean $O_2$ pressure of 10 bars.

If the inventive method is applied these relatively elaborate OBM tuyères can be replaced by the same number of simple oxygen tuyères comprising pipes with an inside diameter of 7 mm. At an oxygen inlet pressure in these tuyères of 120 bars the same amount of oxygen can be blown into the iron bath. The blowing behavior of the converter proves to be extremely quiet when operated by the inventive method. The feared phenomena of so-called blow-throughs or an increased boiling motion involving great splashes cannot be observed. Since the rates of wear of the oxygen tuyères and the total converter bottom are about 6 mm/h of blowing time they are within the range of bottom wear when OBM tuyères are used. For steelmaking operation remarkable economic advantages already result from the saving of amounts of natural gas and the clearly reduced hydrogen contents in the finished steel. Furthermore the tuyères are less expensive, and the relatively elaborate installations for controlling the tuyère protecting medium can be omitted.

The following table shows comparable data and results of prior art methods and the process according to the invention. U.S. Pat. No. 2,855,293, which deals with the treatment of molten metal with oxygen, states under the title "Refractory" in col. 8 from line 20 wear figures for two different refractory materials, namely acidic grog and basic magnesite, which are found in col. 1 of the table. Col. 2 of this table shows the wear of the refractory materials together with known OBM tuyères. In this process a tuyère protecting medium is used, natural gas in the case shown, in an amount of 10% based on the oxygen throughput. The data on refractory consumption are found in German patent no. 34 03 490. These figures are intended to show the wear values and thus lifetimes to be expected for the refractory lining in the large-scale methods in use today, but with the described disadvantages resulting from the hydrocarbon jacket for the oxygen passed into molten metal below the bath surface.

| | Prior art | | | | | |
|---|---|---|---|---|---|---|
| | U.S. Pat. No. 2,855,293 | | German patent 34 03 490 | | Invention | |
| Tuyère dimensions | | | | | | |
| Inside diameter (mm) | | 1.6 | | 24 | | 7 |
| Outside diameter (mm) | | 3.2 | | 34/42 | | 13 |
| Oxygen pressure | | | | | | |
| Minimum (bars) | | 28 | | 6 | | 90 |
| Maximum (bars) | | 70 | | 16 | | 120 |
| Refr. mat./Tuyère wear | | | | | | |
| Minimum rate (mm/h) | Grog | 411 | MgO + C | 5 | MgO + C | 6 |
| Maximum rate (mm/h) | MgO | 3048 | MgO | 10 | MgO | 30 |
| T.p. medium natural gas based on $O_2$ (%) | | — | | 10 | | — |

Comparable data and results of prior art methods and inventive method

Col. 3 of the table shows the corresponding data for the inventive method. Comparison of the values in columns 1 and 3 of this table, which both relate to oxygen blowing without an additional medium into molten metal below the bath surface, makes it clear how great the unforeseeable decrease in wear for the tuyères and surrounding refractory material is when the oxygen is blown into the smelt through the tuyères at a pressure of more than 85 bars. The stated minimum wear of the refractory materials and tuyères in the inventive method is smaller by a factor of 68.5 and the maximum wear by a factor of even 100 as compared to the known process described in the U.S. patent. The hitherto inexplicable effect responsible for this unexpectedly clear reduction of wear in the tuyères when the pressure is increased over 85 bars must be left open here. Possible interpretations have been offered above in this description of the invention.

The method according to the invention can be easily adapted to the operating conditions in reaction vessels for refining molten metal. Among other things, it can replace the inert gas purging means below the bath surface in the relatively large LD converters. It is within the scope of the invention to modify the method for blowing oxidizing gases into molten metal and utilize its advantages by skillful adaptation to existing metallurgical processes. As long as one uses oxidizing gases, in particular oxygen, in the pressure range between 85 bars and 170 bars one is within the scope of the invention.

We claim:

1. A method for blowing oxidizing gases into molten metal located in a reaction vessel having at least one tuyère below the metal bath surface, comprising blowing oxidizing gases into the molten metal from said at least one tuyère and feeding said oxidizing gases to said at least one tuyère at an inlet pressure between 85 bars and 170 bars.

2. The method of claim 1, wherein the oxidizing gas is oxygen.

3. The method of claim 1, wherein the inlet pressure is between 90 bars and 120 bars.

4. The method of claim 2, wherein the oxygen is fed to said at least one tuyère at a temperature between −5° C. and 50° C.

5. The method of claim 4, wherein said temperature is between 10° C. and 30° C.

6. The method of claim 1, wherein said oxygen is fed to said at least one tuyère with a density between 120 $g/dm^3$ and 240 $g/dm^3$.

7. The method of claim 6, wherein the density of the oxygen is between 150 $g/dm^3$ and 170 $g/dm^3$.

8. The method of claim 1, wherein the oxidizing gases pass through an inlet side of said at least one tuyère and through an exit side of said at least one tuyère, the cross section of the at least one tuyère tapers from said inlet side toward said exit side.

* * * * *